US005435782A

United States Patent [19]

Tortul

[11] Patent Number: 5,435,782

[45] Date of Patent: Jul. 25, 1995

[54] TIMING CONTROL DEVICE HAVING AT LEAST ONE INTERMEDIATE TIMING POSITION BETWEEN TWO END OF STROKE POSITIONS

[75] Inventor: Renzo Tortul, S.Pier D'Isonzo, Italy

[73] Assignee: Carraro S.p.A., Carpodarsego, Italy

[21] Appl. No.: 61,252

[22] Filed: May 17, 1993

[30] Foreign Application Priority Data

May 19, 1992 [IT] Italy ..... PD92A0086

[51] Int. Cl.[6] ..... F01L 1/34

[52] U.S. Cl. ..... 464/2; 123/90.17

[58] Field of Search ..... 464/1, 2; 123/90.17, 123/90.31

[56] References Cited

U.S. PATENT DOCUMENTS

| | | | |
|---|---|---|---|
| 4,996,955 | 3/1991 | Akasaka et al. | 123/90.17 |
| 5,040,499 | 8/1991 | Akasaka et al. | 123/90.17 |
| 5,058,539 | 10/1991 | Saito et al. | 464/2 |
| 5,088,456 | 2/1992 | Suga | 464/2 |
| 5,203,290 | 8/1993 | Tsuruta et al. | 123/90.31 |
| 5,309,873 | 5/1994 | Suga et al. | 464/2 |
| 5,311,846 | 5/1994 | Mueller | 464/2 |

*Primary Examiner*—Daniel P. Stodola
*Assistant Examiner*—Eileen A. Dunn
*Attorney, Agent, or Firm*—Sughrue, Mion, Zinn, Macpeak & Seas

[57] ABSTRACT

A timing variator which is constructed to provide at least three predetermined different relative angular settings of the camshaft and the timing system of an internal combustion engine; the variator comprises a piston actuator slidable inside a space against a spring as a pressurized fluid is delivered into a supply chamber thereof. When the piston is to be stopped at a position intermediate to two end-of-stroke positions, in order to obtain an intermediate timing setting, pressurized fluid is delivered behind the piston, thereby producing an additional thrust concurrent with the spring thrust and partly balancing out the pressure of the medium being delivered into the supply chamber.

13 Claims, 3 Drawing Sheets

TIMING CONTROL DEVICE HAVING AT LEAST ONE INTERMEDIATE TIMING POSITION BETWEEN TWO END OF STROKE POSITIONS

BACKGROUND OF THE INVENTION

This invention relates to a timing variator for changing the relative timing of a shaft and a drive associated thereto being of a kind which comprises:

a hub adapted to be coupled rotatively to said shaft;

a case adapted to be coupled rotatively to said hub;

an annular space defined between said case and said hub;

an annular piston mounted in said, annular space to define a pressurized working medium supply chamber therein, said piston being fitted over said hub for axial translatory movement thereon and being movable in said annular space, by the action of said pressurized medium, from a first end-of-stroke position to a second end-of-stroke position against the action of a spring means biasing the piston toward said first position;

tooth coupling means arranged between said hub and said annular piston and between said annular piston and said case, whereby a variation in the relative angular positions of said hub and said case is produced by displacing the piston axially with respect to said hub;

at least one discharge port for discharging working medium from the supply chamber; and a valve means for shutting off said discharge port, being selectively actuatable to control said port according to the piston position in the annular space such that said piston is stopped at at least one intermediate position to said end-of-stroke positions.

Timing variators of this kind are disclosed in European Patent Application No. 91203046.7 filed by the Applicant.

Such variators are used on internal combustion engines to change, with the engine in operation, the angular setting of the engine camshaft relative to its crankshaft, to suit operating parameters specified for the engine.

In some examples of the variator illustrated in the above document, provision is made for stopping the annular piston at an intermediate position to the end-of-stroke positions by setting the piston supply chamber to discharge through a suitable port which ms uncovered by the piston itself upon reaching the desired intermediate position.

The variator structure described therein has some potential disadvantages where, for example, the same pressurized oil as used to lubricate the internal combustion engine incorporating the timing variator is also used as the pressurized medium to operate the piston.

In fact when the variator is actuated for intermediate timing adjustment the piston will stop across the discharge port, leaving it partially uncovered. The necessary condition for the piston to stop at the desired position is that the hydraulic thrust applied to the piston by the oil pressure in the supply chamber should balance the oppositely directed thrust from the spring that biases the piston toward the first end-of-stroke position. In actual practice, this partial setting of the medium supply chamber to discharge will cause the pressure prevailing in the chamber to drop down to the required balance value.

But since the spring is to oppose no more than a weak resistance, such that the piston travel toward the second end-of-stroke position is not slowed down upon a corresponding actuation of the variator, the pressure values of the medium at which the above balance condition will set in for that intermediate timing adjustment are bound to be low ones.

Low pressure values are unacceptable for other functions, especially lubrication, also to be served by the medium.

The underlying problem of this invention is to provide a timing variator which allows at least one intermediate timing position to the two end-of-stroke positions to be attained substantially with no attendant influence on the supply pressure of the piston working medium.

SUMMARY OF THE INVENTION

The solutive idea on which the invention stands is one of partly balancing the pressure of the medium in the supply chamber, when the piston is to be stopped at an intermediate position of its stroke, by delivering fluid under a pressure behind the piston to thereby generate an additional concurrent thrust to that from the spring arranged to bias the piston to the first end-of-stroke position.

This solutive idea is implemented by a timing variator as indicated being characterized in that said discharge port is connected, through a first conduit and said valve means, to a second chamber bounded within said annular space by said piston and located on the axially opposite side of the piston from said pressurized working medium supply chamber.

A timing variator having respective chambers on the two axially opposite sides of the piston is disclosed in U.S. Pat. No. 5058539. However, this document makes no provision for placing the two chambers in fluid communication with each other in order to stop the piston at an intermediate position to the end-of-stroke positions.

Further advantageous features of the invention are brought out in the appended subclaims.

BRIEF DESCRIPTION OF THE DRAWINGS

The invention will now be further described with reference to some preferred embodiments thereof, illustrated by way of example and not of limitation in the accompanying drawings, in which.

DETAILED DESCRIPTION OF THE INVENTION

Figure 2:
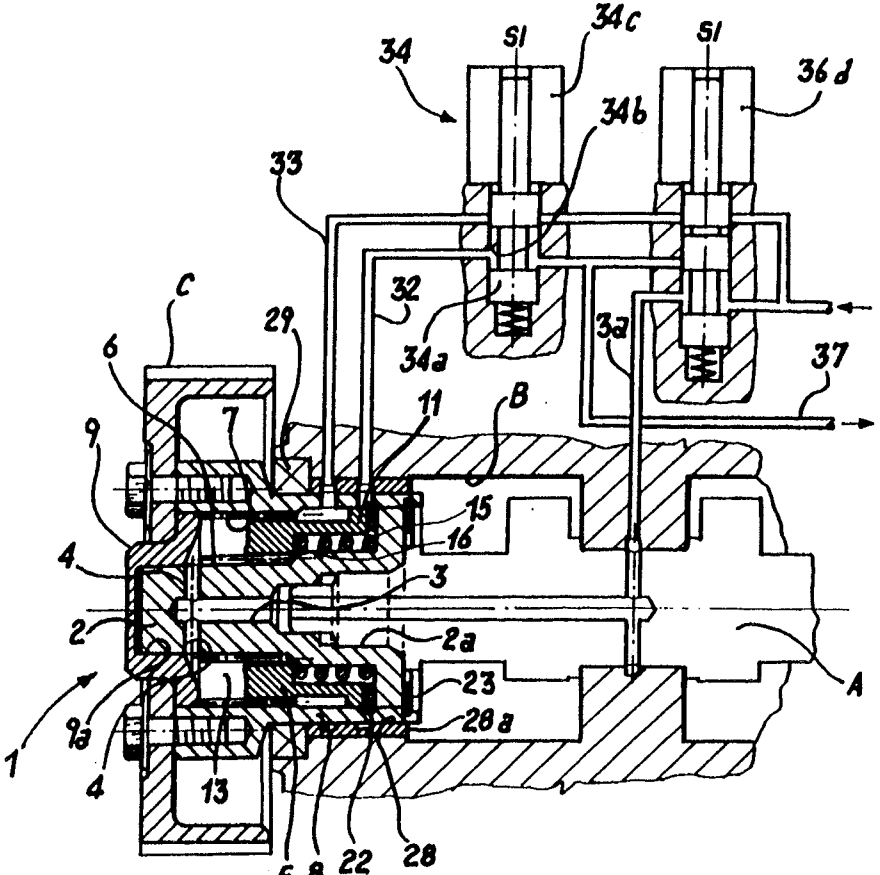
FIG. 1 to 3 are schematic axial section views, respectively showing a first embodiment of the timing variator of this invention at different settings thereof.
Figure 1:
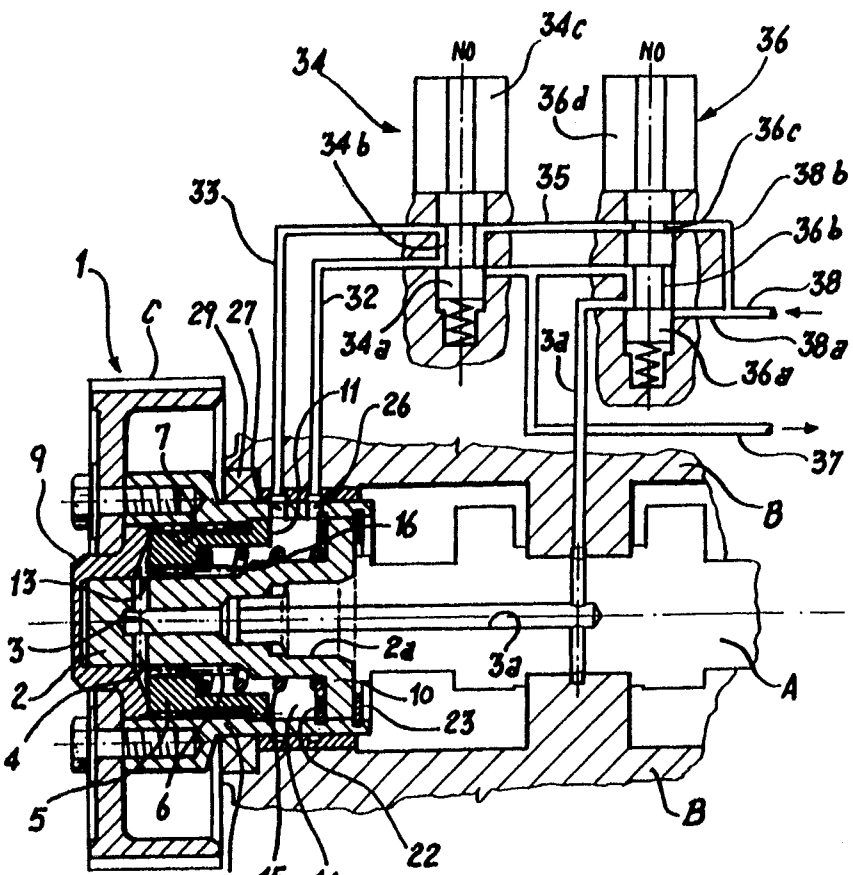
Figure 3:
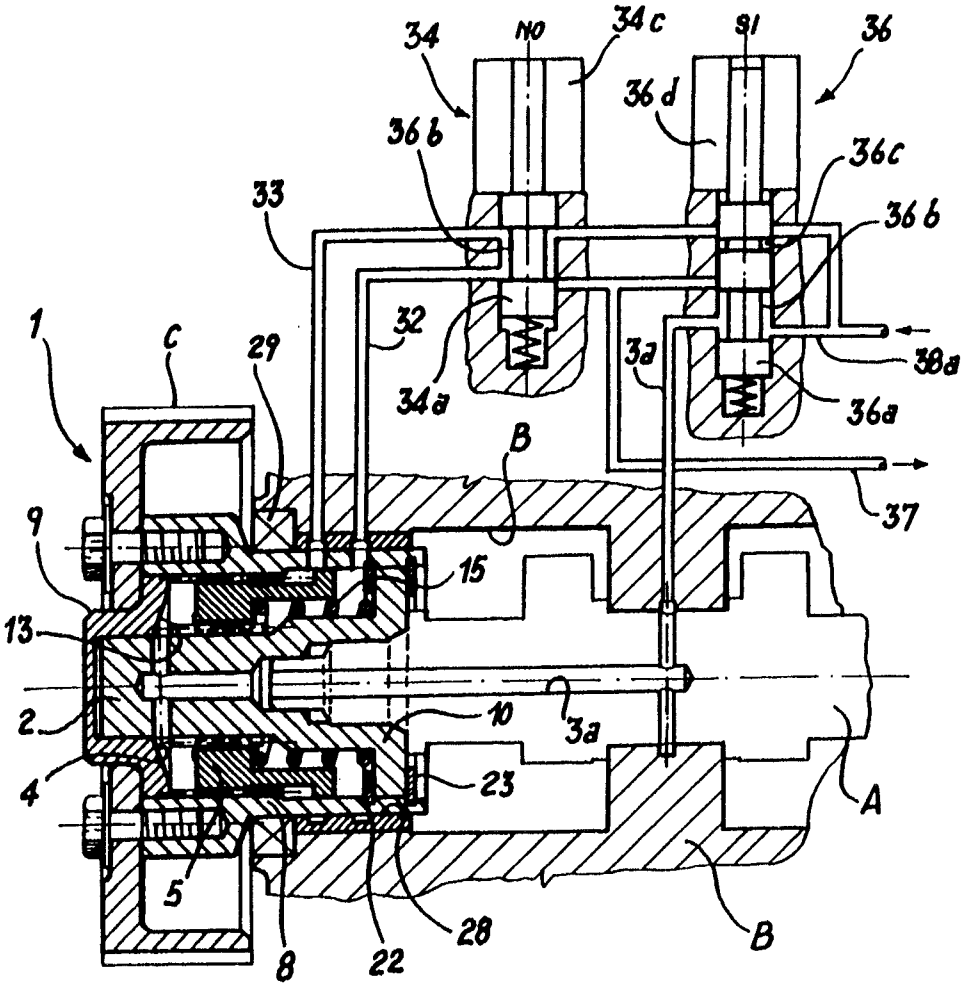

Generally shown at 1 in FIGS. 1 to 3 is a timing variator embodying this invention. The variator 1 is intended for conventional installation on a structural portion B of an internal combustion engine, between its camshaft A and a drive, typically of the cogged belt kind, of which a pulley C is shown that drives the engine timing system.

The timing variator 1 comprises a hub 2 having a threaded axial, hollow 2*a* through which that hub is threaded onto an end threadway of the camshaft A. An axial conduit 3 penetrates said hub which forms, in use an axial extension of an oil supply conduit 3*a* for supplying oil or another working medium under a pressure, which conduit 3*a* extends through the engine structure B and the camshaft A. The conduit 3 branches off into a number of radial distribution conduits 4 for providing the timing change function as explained hereinafter.

An annular piston 5 is fitted over a cylindrical portion of the hub 2 for axial sliding movement on the cylindrical hub portion. This portion is machined with axial splines 6 jointly defining a rectilinear splined profile; in a complementary way piston 5 is provided at its inner side with analogous splines forming a rectilinear splined profile complementary and keyed into engagement with the splines 6.

The combination of the hub 2 and piston 5 is enclosed within a case 8 of generally cylindrical shape; between the case 8 and the hub 2 there is defined a space which is bounded axially by a cover 9 of the case 8, at one end, and a radial flange 10 located at the base of the hub 2 at the other end. The cover 9 defines a blind socket 9*a* accommodating the free end of the hub 2. The flange 10 is a fluid-tight or at least non-leaking fit in the case 8, and is held between two conventional snap rings 22, 23 fitted in respective radial grooves correspondingly formed on the inner wall of the case 8, thereby locking the hub 2 axially with respect to the case.

The latter is formed inside with a coarse pitch helical toothing 7 engaging a complementary toothing formed on the outward surface of the piston 5.

Indicated at 15 is a coil spring fitted around the hub 2 and abutting with its ends an inside shoulder 16 on the piston 5 and the radial flange 10 on the hub, respectively.

The spring 15 constantly biases the piston 5 to a first end-of-stroke position, against the wall of the cover 9 (FIG. 1). The piston 5 is movable against the spring 15, as explained hereinafter, to an oppositely located, second end-of-stroke position where it abuts with its radial flange 11 against the snap ring 22 (FIG. 2).

The space extending between the case 8 and the hub 2 is divided by the piston 5 into first and second annular chambers with complementarily varying volumes, respectively shown at 13 and 14. The supply conduits 4 for the pressurized working oil to the variator 1 open to the first chamber 13. .Accordingly, this chamber 13 will also be referred to as the variator supply chamber.

Formed through the skirt of the case 8 are two radial ports 26, 27, each including one or more holes radially therethrough. The port 26 locates adjacent to the snap ring 22, such that it is open to the second chamber 14 at all times whereas the port 27 is positioned intermediate on the case, such that it will be substantially shut off by the radial flange 11 of the piston 5 as the latter stopped at the desired intermediate position. That port 27 will also be referred to as the discharge port for the medium supplied into the first chamber, and the radial flange 11 acts as a shutter means therefor to control the opening thereof according to the setting of the piston with respect to its desired intermediate position.

The case 8 is received, at the location of the two ports 26 and 27, rotatably in a socket 28 which may be defined by a bearing 28*a* for the variator provided on the engine structure B or by another ring-shaped element encircling the case at said location. Mounted between the outer case skirt and the structure B are seals 29 providing a fluid-tight fit. Formed within the socket 28 at the location of each of the ports 26, 27 is a groove acting as a manifold between a corresponding one of the ports 26, 27 and respective first and second conduits 33, 32 being both associated with a first valve means 34. The valve means 34 comprises a slide control valve having a shutter 34*a* formed with a groove 34*b* which is operated conventionally e.g. through a solenoid actuator 34*c*.

That valve means 34 is arranged for connecting through its groove 34*b*, while de-actuated, the conduits 32, 33 to each other and to a third conduit 35 leading to a second valve means 36, or while actuated, the conduit 32 alone to a discharge conduit 37, thereby shutting off the conduit 33.

The second valve means 36 also comprises a slide control valve having a shutter 36*a* formed with two grooves 36*b,c*, which is also operated in a conventional manner such as through a solenoid actuator 36*d*.

That valve means 36 is arranged to communicate, while de-actuated, a source of pressurized fluid represented by a conduit 38 divided into two branches 38*a,b*, to the conduit 35 leading to the first valve means, thereby connecting the conduit 3*a* to the discharge conduit 37, or to communicate, while actuated, that same source of pressurized fluid, represented by the conduit 38, to the conduit 3*a*.

In FIG. 1, the variator is shown in a first operating condition with the piston 5 abutting the first end-of-stroke position. With the variator arranged as in this, the first, embodiment the valve means 34, 36 can be set to have pressurized oil supplied into the second chamber 14, thereby exerting a thrust on the piston 5 concurrently with the spring 15. To this aim, both valve means 34, 36 would be de-actuated such that both conduits 32 and 33 are put into communication with the conduit 38. In a like manner, the first chamber 13 is communicated to the discharge conduit 37 through the supply conduit 3.

In FIG. 2 the variator 1 is shown in a second operating condition with the piston 5 abutting the second end-of-stroke position on the axially opposite side from the previous example. To achieve this condition, both valve means 34, 36 are actuated to communicate the first and second chambers to the conduit 38 and the discharge conduit 37, respectively. The port 27 and its associated conduit 33 are shut off by the shutter 34*a*.

In FIG. 3, the variator is shown in a third operating condition with the piston 5 stopped intermediate to the foregoing positions. To attain this condition the valve means 34, 36 are in a de-actuated and an actuated state, respectively, thereby placing both conduits 32, 33 into fluid communication and at the same time supplying pressurized oil into the first chamber 13 through the supply conduit 3. In this condition, the piston 5 will be forced to locate itself with the annular flange 11 across the port 27. As long as that port is open to the first chamber 13, any pressurized oil seeping into it will be directed into the second chamber 14 to apply a thrust force to the piston 5 which adds to the axial thrust from the spring 15. Consequently, the piston 5 will be displaced axially with respect to the hub until the port 27 is shut off by its radial flange 11. The piston will stop at the intermediate position upon the overall thrust exerted on either sides thereof attaining a balanced state with a pressure inside the chamber 13 and the conduit 3 equal to the sum of the pressure prevailing in the second chamber 14 plus the required pressure to balance the spring 15.

Notice, moreover, that with the arrangement described, in any of the three operating conditions of the variator 1 there will always be pressurized oil present at at least one of the ports 26, 27 to keep the socket 28 lubricated.

Figure 6:
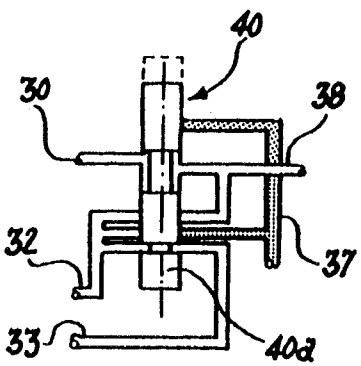
FIGS. 4 to 6 are schematic views of different control valve means for the timing variator shown in the preceding Figures, at its respective settings of FIGS. 1–3.
Figure 4:
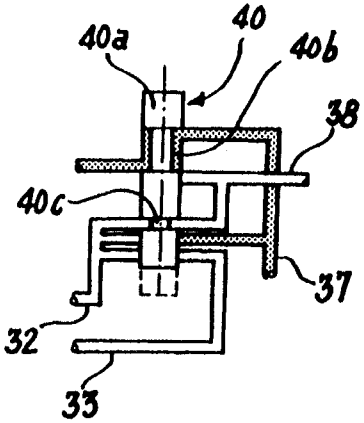
Figure 5:
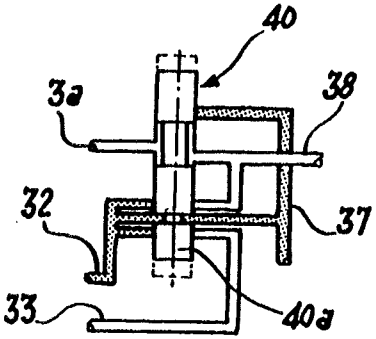

In a modified embodiment shown schematically FIGS. 4 to 6, the first and second valve means are integrated to a single valve body, generally indicated at 40. That body 40 includes a control slide valve having a shutter 40*a* formed with two grooves 40*b,c*, which shutter can be moved by means of conventional actuators to the three positions described. The conduits associated with the valve body 40 are denoted by the same reference numerals as in FIGS. 1–3, and their connections for the three different positions of the shutter 40*a* as shown in FIGS. 4, 5 and 6 will result in the variator being operated as describe. already in connection with the embodiment shown in FIGS. 1, 2 and 3 respectively.

Figure 8:
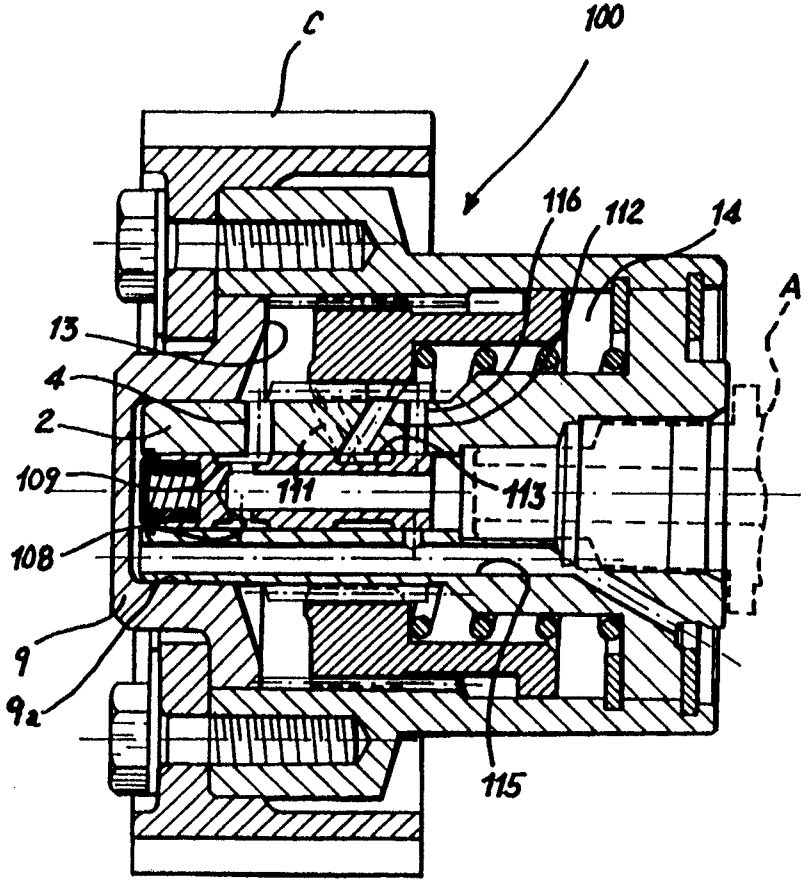
FIGS. 7 and 8 are axial section views of a second embodiment of the timing variator of this invention, shown at corresponding settings to those of FIGS. 2 and 3.
Figure 7:
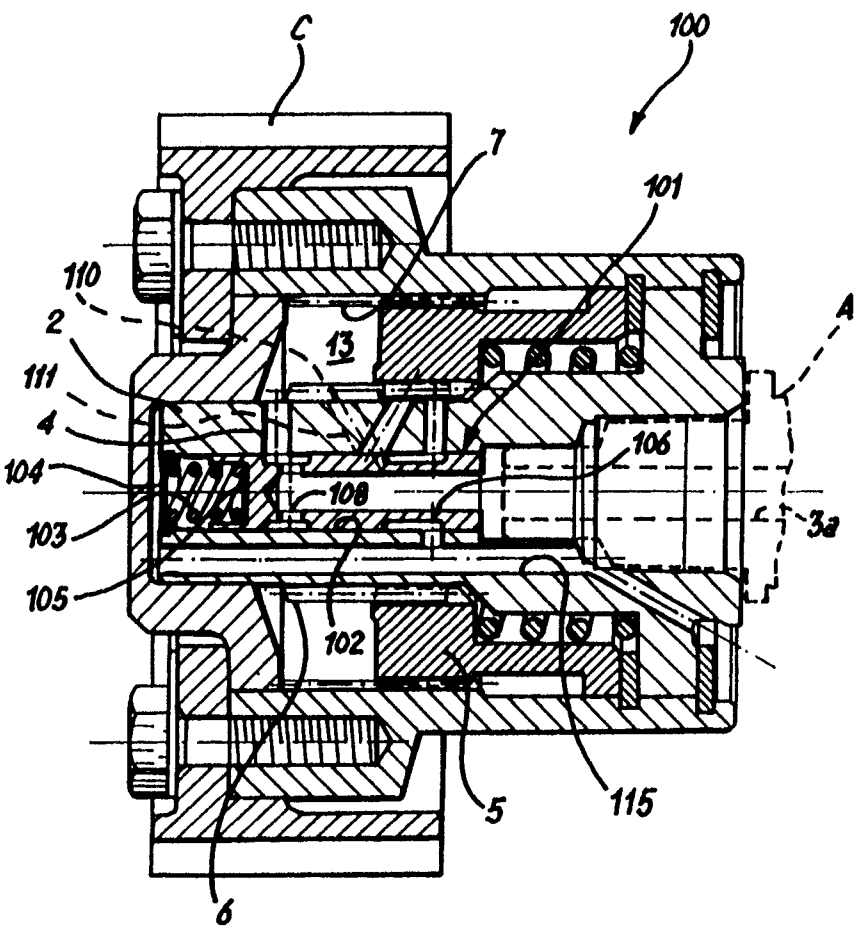

Shown in FIGS. 7 and 8 is a second embodiment of a timing variator according to this invention. The variator is generally indicated at 100 and carries, for similar parts thereof, the same reference numerals as in the previous embodiment.

The variator 100 has been depicted with the piston 5 at the second end-of-stroke position (FIG. 7) and at the intermediate position (FIG. 8) it being understood that when in the first position, the piston would abut the wall of the cover 9 as described in the previous embodiment.

Outstanding among the differences is that in this variator 100, the means interconnecting the two chambers 13 14 are integrated to the variator itself. In this respect, the variator 100 is provided with a valve means which includes a sliding shutter 101 movable within an axial seat 102 in the hub 2 and subjected to the action of a spring 103 whose ends are respectively active between an end cap 104 retained on the hub end received inside the socket 9*a* and a bell formation 105 provided on the confronting shutter end. Thus, the shutter 101 is spring biased to a first working position (FIG. 7) against the end of the seat 102 facing the camshaft. When pressurized oil is present inside the supply conduit 3*a*, it will also be subjected to the pressure from that medium generating oppositely directed thrust to that from the spring 103. At pressure values above a predetermined threshold value dependent on the construction parameters of the shutter 101 and the spring 103, the shutter will be moved to a second working position (FIG. 8) abutting the axially opposite end of the seat 102. The shutter 101 can also be moved to its second working position by some other motive means, such as those described in connection with the embodiments of FIGS. 5 and 6 in the aforementioned European Patent Application No. 91203046.7.

The supply conduit 3*a* is extended into an axial conduit 106 in the shutter 101 which is divided into radial conduits 108 placed in constant fluid communication with the conduits 4 in the the hub 2 by a groove 109.

The discharge port 110 for the medium in the first chamber, through which the intermediate stop position for the piston is set, is formed at the outlet of a first conduit 111 opening between the first chamber 13 and the seat 102 of the shutter 101. That port location is selected in a similar manner to the previous example. A second conduit 112 angularly offset from the conduit 111 also opens into the hub 2 between the seat 102 and the hub portion adjacent to the splined portion 6. Said first and second conduits are selectively shut off by the shutter 101 occupying the position of FIG. 7, and are in fluid communication through an annular groove 113 on the shutter 101 with the latter in the position of FIG. 8.

Finally, a discharge conduit 115 is formed in the hub 2 which has radial branch-offs 116 leading to the second chamber 14 and is shut off by the shutter 101 when in the position of FIG. 8.

Notice that with the structure described, the variator 100 can be controlled to bring the piston 5 to the second end-of-stroke position by supplying the variator with oil at pressures below the control pressure for moving the shutter to the second working position of FIG. 8. This is an advantageous features in that the corresponding intermediate timing setting is usually required with the engine running at low rpm, and hence with the lubrication oil pressure at a general low.

Among the principal advantages afforded by this invention is that it ensures substantial stability of the pressure values through the engine lubricating system irrespective of adjustments applied by the timing variator. In addition, with the arrangement of the first embodiment, appropriate lubrication of the variator holding socket can be obtained as a side feature. Another advantage of the arrangement of the second embodiment is that the valve means for intermediate timing setting can be integrated to the variator. The latter is advantageously driven by pressure variations in the working medium.

What is claimed is:

1. A timing variator for changing the relative timing of a rotary shaft and an associated drive, comprising:

a hub adapted to be coupled rotatively to said shaft;

a case adapted to be coupled rotatively to said hub;

an annular space defined between said case and said hub;

an annular piston mounted in said annular space to define a pressurized working medium supply chamber therein on one side of said annular piston, said piston being fitted over said hub for axial translatory movement thereon and being movable in said annular space, by the action of said pressurized medium, from a first end-of-stroke position to a second end-of-stroke position against the action of a spring means biasing the annular piston toward said first end-of-stroke position;

tooth coupling means arranged between said hub and said annular piston and between said annular piston and said case for producing a variation in the relative angular positions of said hub and said case by displacing the annular piston axially with respect to said hub;

at least one discharge port for discharging working medium from the supply chamber; and a first valve means for shutting off said discharge port being selectively actuatable to control said discharge port according to the annular piston position in the annular space such that said annular piston is stopped at at least one intermediate position to said end-of-stroke positions, a second chamber located within said annular space on the opposite side of said annular piston from said supply chamber and connection means between said chambers for selectively placing said chambers in fluid communication through said discharge port upon a corresponding timing variation to said at least one intermediate position of the annular piston being selected.

2. A timing variator according to claim 1, wherein said connection means comprise first and second conduits respectively extending between said discharge port and said first valve-means, and between said first valve means and said second chamber, said first valve means being arranged for:

shutting off the first conduit in order to select the corresponding variator command to the second end-of-stroke position, and placing said chambers in fluid communication in order to select the corresponding variator command to the intermediate position.

3. A timing variator according to claim 2, wherein a second valve means is provided, and wherein said first and second valve means are arranged for supplying said pressurized medium into the second chamber in order to select the corresponding variator command to the first end-of-stroke position.

4. A timing variator according to claim 3, wherein the second valve means is arranged for alternately communicating a source of said pressurized medium to said supply chamber and said first valve means, respectively, upon the corresponding variator command to the first end-of-stroke position being required.

5. A timing variator according to claim 3, wherein said first and second valve means are integrated to a single valve body.

6. A timing variator according to claim 1, wherein the discharge port of the supply chamber is open to said case outside.

7. A timing variator according to claim 6, wherein the case is received, an the location of said discharge port, rotatably in a socket, wherein the working medium is lubricating oil, and wherein said discharge port forms a lubricant supply conduit for lubricating said socket.

8. A timing variator according to claim 7, wherein a second port is open to said case outside between the second chamber and said socket, either or both of said ports forming a lubricant supply conduit for lubricating said socket.

9. A timing variator according to claim 1, wherein said connection means between said chambers are integrated to the variator.

10. A timing variator according to claim 9, wherein said connection means comprise:

a sliding shutter mounted in a corresponding seat on the hub, a first conduit extending in said hub between said, discharge port and said seat for selective shutting off by said shutter with the latter in a first working position thereof, a second conduit extending in said hub from said seat for placing said first conduit in fluid communication with the second chamber, with said shutter in a second working position thereof, a spring means biasing said shutter toward said first working position, and a motive means for moving said shutter to said second working position against said spring means.

11. A timing variator according to claim 10, comprising a working medium discharge conduit extending in said hub and being provided with at least one branch-off extending in the second chamber, said at least one branch-off being shut off when the shutter occupies its second working position.

12. A timing variator according to claim 10, wherein said medium is delivered into said supply chamber under at least two discrete pressure levels, said shutter defining in its respective seat a piston subjected to the hydraulic thrust from the working medium to provide said motive means.

13. A timing variator according to claim 9, wherein said connection means are such that said piston is moved toward the second end-of-stroke position when subjected to a first pressure level of said medium, and moved toward said intermediate position when subjected to a second pressure level of said medium above said first level.

* * * * *